US012049345B2

(12) United States Patent
Skripps et al.

(10) Patent No.: US 12,049,345 B2
(45) **Date of Patent: *Jul. 30, 2024**

(54) CHILD-SAFE CANNABIS PACKAGING

(71) Applicants: Thomas Skripps, Braintree, MA (US); Peter Carpinteri, Somerville, MA (US); Andrew Seifert, Plymouth, MA (US)

(72) Inventors: Thomas Skripps, Braintree, MA (US); Peter Carpinteri, Somerville, MA (US); Andrew Seifert, Plymouth, MA (US)

(73) Assignee: Superior Bindery Inc., Braintree, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/901,507

(22) Filed: Sep. 1, 2022

(65) Prior Publication Data

US 2023/0037352 A1 Feb. 9, 2023

Related U.S. Application Data

(63) Continuation-in-part of application No. 17/111,685, filed on Dec. 4, 2020, now Pat. No. 11,447,311.

(51) Int. Cl.

| | |
|---|---|
| ***B65D 5/38*** | (2006.01) |
| ***B65D 5/32*** | (2006.01) |
| ***B65D 5/54*** | (2006.01) |
| ***B65D 5/66*** | (2006.01) |

(52) U.S. Cl.

CPC ..... *B65D 5/38* (2013.01); *B65D 5/326* (2013.01); *B65D 5/5405* (2013.01); *B65D 5/66* (2013.01); *B65D 2215/02* (2013.01)

(58) Field of Classification Search

CPC . B65D 50/06; B65D 5/38; B65D 5/62; B65D 5/326; B65D 5/5405; B65D 5/66; B65D 2215/02

USPC ..... 206/242, 267

See application file for complete search history.

(56) References Cited

U.S. PATENT DOCUMENTS

| | | | |
|---|---|---|---|
| 502,952 | A | 8/1893 | Craw |
| 533,044 | A | 1/1895 | Bingham |
| 1,253,489 | A | 1/1918 | Houghland |
| 1,925,113 | A | 9/1933 | Rutledge |
| 2,064,488 | A | 12/1936 | Neely |
| 2,295,747 | A | 9/1942 | Mills |
| 2,309,111 | A | 1/1943 | Hothersall |
| 2,378,003 | A | 6/1945 | Duell |
| 2,410,923 | A | 11/1946 | Beardsley |
| 2,426,856 | A | 9/1947 | Berg |
| 2,605,892 | A | 8/1952 | Waber |

(Continued)

FOREIGN PATENT DOCUMENTS

| | | |
|---|---|---|
| DE | 20215083 | 3/2004 |
| WO | 2017051427 | 3/2017 |

*Primary Examiner* — Rafael A Ortiz

(74) *Attorney, Agent, or Firm* — Lambert Shortell & Connaughton; David J. Connaughton, Jr.; Justin P. Tinger

(57) ABSTRACT

The present disclosure relates to child-safe packaging. In accordance with aspects and embodiments, a child-safe packaging system is provided comprising a cardstock inner package having an internal cavity dimensioned to hold a product and a cardstock outer sleeve having an open end a closed end, wherein the inner package is sized to frictionally fit within the outer sleeve.

14 Claims, 7 Drawing Sheets

(56) References Cited

U.S. PATENT DOCUMENTS

| | | | |
|---|---|---|---|
| 2,613,806 | A | 10/1952 | Testi |
| 2,777,570 | A | 1/1957 | Mytinger |
| 3,005,546 | A | 10/1961 | Sanford |
| 3,033,355 | A | 5/1962 | Van Sickle |
| 3,082,902 | A | 3/1963 | Kimbrough |
| 3,129,817 | A | 4/1964 | Rohdin |
| 3,286,900 | A | 11/1966 | Keith |
| 3,334,734 | A | 8/1967 | Meyers |
| 3,362,564 | A | 1/1968 | Mueller |
| 3,459,296 | A | 8/1969 | Berg |
| 3,610,410 | A | 10/1971 | Seeley |
| 3,648,918 | A | 3/1972 | Van Inwagen |
| 3,651,928 | A | 3/1972 | Weisman |
| 3,670,881 | A | 6/1972 | Dutcher |
| 3,741,387 | A | 6/1973 | Whitecar |
| 3,761,010 | A | 9/1973 | Rosenburg |
| 3,765,595 | A | 10/1973 | Bernhardt |
| 3,782,584 | A | 1/1974 | Swenson |
| 3,809,220 | A | 5/1974 | Arcudi |
| 3,809,221 | A | 5/1974 | Compere |
| 3,811,564 | A | 5/1974 | Braber |
| 3,835,995 | A | 9/1974 | Jaines |
| 3,872,970 | A | 3/1975 | Edison |
| 3,888,350 | A | 6/1975 | Horvath |
| 3,899,080 | A | 8/1975 | Brunda |
| 3,905,479 | A | 9/1975 | Gerner |
| 3,912,081 | A | 10/1975 | Haines |
| 3,912,082 | A | 10/1975 | Gerner |
| 3,921,805 | A | 11/1975 | Compere |
| 3,924,746 | A | 12/1975 | Haines |
| 3,924,747 | A | 12/1975 | Gerner |
| 3,941,248 | A | 3/1976 | Moser |
| 3,949,868 | A | 4/1976 | Allen |
| 4,011,949 | A | 3/1977 | Braber |
| 4,076,117 | A | 2/1978 | Wisdom |
| 4,081,126 | A | 3/1978 | Barnard |
| 4,120,400 | A | 10/1978 | Kotyuk |
| 4,125,190 | A | 11/1978 | Davie |
| 4,192,422 | A | 3/1980 | Kotyuk |
| 4,231,477 | A | 11/1980 | De Felice |
| 4,284,204 | A | 8/1981 | Carey |
| 4,319,680 | A | 3/1982 | Hiemstra |
| 4,364,488 | A | 12/1982 | Anjou |
| 4,401,210 | A | 8/1983 | Anjou |
| 4,437,566 | A | 3/1984 | Szahler |
| 4,485,915 | A | 12/1984 | Berghahn |
| 4,506,789 | A | 3/1985 | Dlugosz |
| 4,535,890 | A | 8/1985 | Artusi |
| 4,561,544 | A | 12/1985 | Reeve |
| 4,589,549 | A | 5/1986 | Hehn |
| 4,895,296 | A | 1/1990 | Trauschke |
| 4,946,057 | A | 8/1990 | Connolly |
| 5,046,618 | A | 9/1991 | Wood |
| 5,088,599 | A | 2/1992 | Mahler |
| 5,111,973 | A | 5/1992 | Mueller |
| 5,172,812 | A | 12/1992 | Wharton |
| 5,244,093 | A | 9/1993 | Carmichael |
| 5,277,304 | A | 1/1994 | Brizzi |
| 5,299,711 | A | 4/1994 | Romick |
| 5,310,060 | A | 5/1994 | Bitner |
| 5,356,011 | A | 10/1994 | Romick |
| 5,379,890 | A | 1/1995 | Mahler |
| 5,383,595 | A | 1/1995 | Hallam |
| 5,529,188 | A | 6/1996 | Coggswell |
| 5,586,717 | A | 12/1996 | Hallam |
| 5,680,782 | A | 10/1997 | Komatsu |
| 5,788,079 | A | 8/1998 | Bouthiette |
| 5,878,887 | A | 3/1999 | Parker |
| 5,941,364 | A | 8/1999 | Wei |
| 6,008,454 | A | 12/1999 | Kawakita |
| 6,012,631 | A | 1/2000 | Hallam |
| 6,027,018 | A | 2/2000 | Yocum |
| 6,032,795 | A | 3/2000 | Ehrlund |
| 6,047,829 | A | 4/2000 | Johnstone |
| 6,109,514 | A | 8/2000 | Otis |
| 6,230,893 | B1 | 5/2001 | Karow |
| 6,230,917 | B1 | 5/2001 | Whitnell |
| 6,230,966 | B1 | 5/2001 | Beales |
| 6,375,956 | B1 | 4/2002 | Hermelin |
| 6,412,636 | B1 | 7/2002 | Jones |
| 6,460,693 | B1 | 10/2002 | Harrold |
| 6,491,211 | B1 | 12/2002 | Evans |
| 6,523,691 | B2 | 2/2003 | Raj |
| 6,641,031 | B2 | 11/2003 | Evans |
| 6,676,013 | B2 | 1/2004 | Auclair |
| 6,752,272 | B2 | 6/2004 | Jones |
| 6,874,636 | B2 | 4/2005 | Paliotta |
| 6,912,878 | B2 | 7/2005 | Belden |
| 6,926,161 | B2 | 8/2005 | Miceli |
| 7,044,359 | B1 | 5/2006 | Cohen |
| 7,188,729 | B2 | 3/2007 | DeJonge |
| 7,353,969 | B2 | 4/2008 | McHutchinson |
| 7,389,875 | B2 | 6/2008 | Sandberg |
| 7,469,786 | B1 | 12/2008 | Rowley |
| 7,578,428 | B2 | 8/2009 | Charlton |
| 7,588,149 | B2 | 9/2009 | Gelardi |
| 7,617,930 | B2 | 11/2009 | Jones |
| 7,637,375 | B2 | 12/2009 | Sattel |
| 7,658,287 | B2 | 2/2010 | Hession |
| 7,661,534 | B2 | 2/2010 | Saclier |
| 7,708,142 | B2 | 5/2010 | Ehrlund |
| 7,757,843 | B2 | 7/2010 | Katsis |
| 7,810,640 | B2 | 10/2010 | Weston |
| 7,819,250 | B2 | 10/2010 | Sattel |
| 7,845,495 | B2 | 12/2010 | Baker |
| 7,845,496 | B2 | 12/2010 | Iession |
| 7,854,325 | B2 | 12/2010 | Bentele |
| 8,011,512 | B2 | 9/2011 | Brollier |
| 8,087,540 | B2 | 1/2012 | Bailey |
| 8,096,411 | B2 | 1/2012 | Bailey |
| 8,181,774 | B2 | 5/2012 | Tetsuya |
| 8,196,749 | B2 | 6/2012 | Chatelain |
| 8,220,636 | B2 | 7/2012 | Beecroft |
| 8,235,204 | B2 | 8/2012 | Loughman |
| 8,342,330 | B2 | 1/2013 | Weston |
| 8,499,936 | B2 | 8/2013 | Albrecht |
| 8,523,049 | B2 | 9/2013 | Fitzwater |
| 8,553,250 | B2 | 10/2013 | Kato |
| 8,698,627 | B2 | 4/2014 | Londo |
| 8,757,458 | B2 | 6/2014 | Nebel |
| 8,899,414 | B2 | 12/2014 | Chatelain |
| 8,963,714 | B2 | 2/2015 | Medhal |
| 8,991,606 | B2 | 3/2015 | Ortenzi |
| 9,120,592 | B2 | 9/2015 | Kenner |
| 9,174,761 | B1 | 11/2015 | Grist |
| 9,174,780 | B2 | 11/2015 | Gelardi |
| 9,278,792 | B2 | 3/2016 | Linssen |
| 9,359,123 | B2 | 6/2016 | Bhattacharjee |
| 9,475,605 | B2 | 10/2016 | Everett |
| 9,488,822 | B2 | 11/2016 | Machida |
| 9,594,341 | B2 | 3/2017 | Kuruma |
| 9,630,740 | B2 | 4/2017 | Ishikawa |
| 9,663,266 | B2 | 5/2017 | Schwester |
| 9,702,887 | B2 | 7/2017 | Neeper |
| 9,731,847 | B2 | 8/2017 | Jorgensen |
| 9,815,584 | B2 | 11/2017 | Schwester |
| 9,896,235 | B2 | 2/2018 | Rajter |
| 9,957,079 | B2 | 5/2018 | Kenner |
| 9,981,788 | B2 | 5/2018 | Skinner |
| 10,144,570 | B2 | 12/2018 | Weston |
| 10,252,831 | B2 | 4/2019 | Kenner |
| 10,384,828 | B2 | 8/2019 | Rajter |
| 10,479,581 | B2 | 11/2019 | Chambers |
| 10,696,443 | B1 | 6/2020 | Mundt |
| 10,737,826 | B2 | 8/2020 | Everett |
| 10,889,404 | B2 | 1/2021 | Tsai |
| 10,934,072 | B2 | 3/2021 | Lantz |
| 10,968,014 | B2 | 4/2021 | Mazurek |
| 11,046,476 | B2 | 6/2021 | Whitehurst |
| 2002/0134824 | A1 | 9/2002 | Mills |
| 2002/0185404 | A1 | 12/2002 | Donegan |
| 2003/0085262 | A1 | 5/2003 | Evans |
| 2004/0045858 | A1 | 3/2004 | Harrold |
| 2004/0050748 | A1 | 3/2004 | Ehrlund |

(56) References Cited

U.S. PATENT DOCUMENTS

| | | | |
|---|---|---|---|
| 2004/0099565 | A1 | 5/2004 | Dehlin |
| 2004/0188311 | A1 | 9/2004 | Paliotta |
| 2004/0217116 | A1 | 11/2004 | Offerman |
| 2004/0262189 | A1 | 12/2004 | Fraser |
| 2005/0097931 | A1 | 5/2005 | Miller |
| 2005/0218202 | A1 | 10/2005 | Braoudakis |
| 2006/0000737 | A1 | 1/2006 | Vogel |
| 2007/0181458 | A1 | 8/2007 | Ehrlund |
| 2007/0221518 | A1 | 9/2007 | Chatelain |
| 2008/0156686 | A1 | 7/2008 | Hluchan |
| 2008/0257773 | A1 | 10/2008 | Gelardi |
| 2009/0152134 | A1 | 6/2009 | Katsis |
| 2009/0184022 | A1 | 7/2009 | Coe |
| 2009/0184023 | A1 | 7/2009 | Brollier |
| 2011/0011765 | A1 | 1/2011 | Gelardi |
| 2012/0012497 | A1 | 1/2012 | Weston |
| 2012/0074823 | A1 | 3/2012 | Bezich |
| 2012/0118780 | A1 | 5/2012 | Polloni |
| 2012/0160724 | A1 | 6/2012 | Gelardi |
| 2012/0234701 | A1 | 9/2012 | Albrecht |
| 2012/0261275 | A1 | 10/2012 | Intini |
| 2013/0193029 | A1 | 8/2013 | Weston |
| 2013/0233756 | A1 | 9/2013 | Weston |
| 2014/0262839 | A1 | 9/2014 | Le |
| 2015/0336730 | A1 | 11/2015 | Shields |
| 2016/0251107 | A1 | 9/2016 | Everett |
| 2017/0036808 | A1 | 2/2017 | Everett |
| 2018/0022498 | A1 | 1/2018 | Everett |
| 2018/0162587 | A1 | 6/2018 | Bressan |
| 2019/0084715 | A1 | 3/2019 | Whitehurst |
| 2020/0102113 | A1 | 4/2020 | Laughlin |
| 2021/0171235 | A1* | 6/2021 | Boland ..... B65D 5/38 |
| 2021/0276758 | A1* | 9/2021 | Chen ..... B31B 50/20 |
| 2021/0276767 | A1* | 9/2021 | Creighton ..... B65D 43/0272 |
| 2021/0323719 | A1* | 10/2021 | Altman ..... B65D 50/046 |
| 2021/0371172 | A1* | 12/2021 | Markarian ..... B65D 59/04 |

* cited by examiner

CHILD-SAFE CANNABIS PACKAGING

FIELD OF DISCLOSURE

The present disclosure relates to cannabis product packaging, and more specifically, to child-safe packaging for the commercial and retail sale of cannabis products. The disclosed packaging advantageously provides an obstacle to child access while allowing easy access to an adult user.

BACKGROUND

As of 2020, the medical use of cannabis is legalized in 33 states, four out five permanently inhabited U.S. territories, and the District of Columbia. The recreational use of cannabis is legalized in 11 states and the District of Columbia, and, with the exception of the District of Columbia, the commercial distribution of cannabis is legal in all states in which the recreational use of cannabis is legal. Furthermore, while cannabis remains illegal at the federal level, cannabidiol (CBD), a non-psychoactive component of cannabis, is legal at the federal level and products containing CBD can be legally commercially distributed, though restrictions, legality of distribution is state-dependent.

While the legality of the commercial sale of cannabis products and products containing cannabis continues to vary by state, an overwhelming majority of Americans favor federal legalization. While cannabis is deemed safe for adults, it should not be consumed by children, and there are age restrictions on who can legally purchase and/or consume recreational cannabis products. There is already a need for child-safe packaging for cannabis products, and as more states continue to legalize the commercial sale of cannabis products, this need will continue to increase.

Many cannabis products are sold commercially appealing, distinctive, packaging. With a relatively recent market opening, distributors of cannabis products rushing to distinguish their products from one another to capture a lasting piece of the cannabis market share. Cannabis retailers often use bright colors and "fun" branding to differentiate their products from what is rapidly becoming a crowded market. These packages, though visually unique, are also appealing to young children. Cannabis can also be ingested, and is thus sold in edible forms, including in the form of chocolate bars and gummy candies. The combination of brightly colored packaging and knowledge of potential candy inside makes cannabis containing products particularly attractive to children unaware of the dangers cannabis poses to them.

There thus exists a need for child-safe cannabis packaging that remains both appealing to users but creates a sufficient obstacle to access by children. The present disclosure provides cannabis packaging that advantageously includes safety features that minimize the inadvertent access by a child without distracting from any branding applied to the packaging. The disclosed packaging allows easy access by an adult and can be used for any type of product. The disclosed packaging may be extended to products beyond cannabis but finds immediate application in the rapidly growing retail cannabis market.

SUMMARY OF DISCLOSURE

The present disclosure fills the market need of providing child-safe packaging for cannabis products. In accordance with aspects and embodiments, a cannabis packaging system is provided that includes an inner package and an outer sleeve. The inner package includes an internal cavity and is dimensioned to hold a cannabis product. The outer sleeve has an open end and a closed end, and the inner package frictionally fits within the outer sleeve. The packaging is inexpensive and both components may be made of cardstock or similar materials. The outer sleeve may be reinforced with a tear resistant material. In some embodiments, the tear resistant material may a fiber tape or flexible plastic tape applied the interior of the sleeve at surfaces and edges susceptible to tearing, or may be a tear resistant coating such as a fiber material or flexible plastic layer applied to the portions or the entirety of the inner surface of the outer sleeve.

The closed end of the outer sleeve has an access hole that provides access to the first end of the inner package. An adult user can use a key, or any similar item they have on hand, to apply force to the inner package via the access hole. Application of that small amount of force to the inner package causes the inner package to overcome the frictional fit that holds it within the outer sleeve and it slides at least partially out of the outer sleeve, allowing the user to grasp it and pull it the remaining way out.

In some embodiments, the outer sleeve may be slightly longer than the inner packaging, making it more difficult to simply grasp the inner package. The inner package may be coated with a specialty coating that enhancing the frictional fit between it and the outer sleeve. This same coating may be applied to an inner surface of the outer sleeve to further enhance the friction between the two. The coating may further be applied to the entire outer surface of the outer sleeve.

The presently disclosed child-safe packaging may further be used for non-cannabis products. The disclosed packaging may be used to package any product and may be particularly useful in the commercial packaging of products that may pose a danger to children.

DETAILED DESCRIPTION

Figure 1:
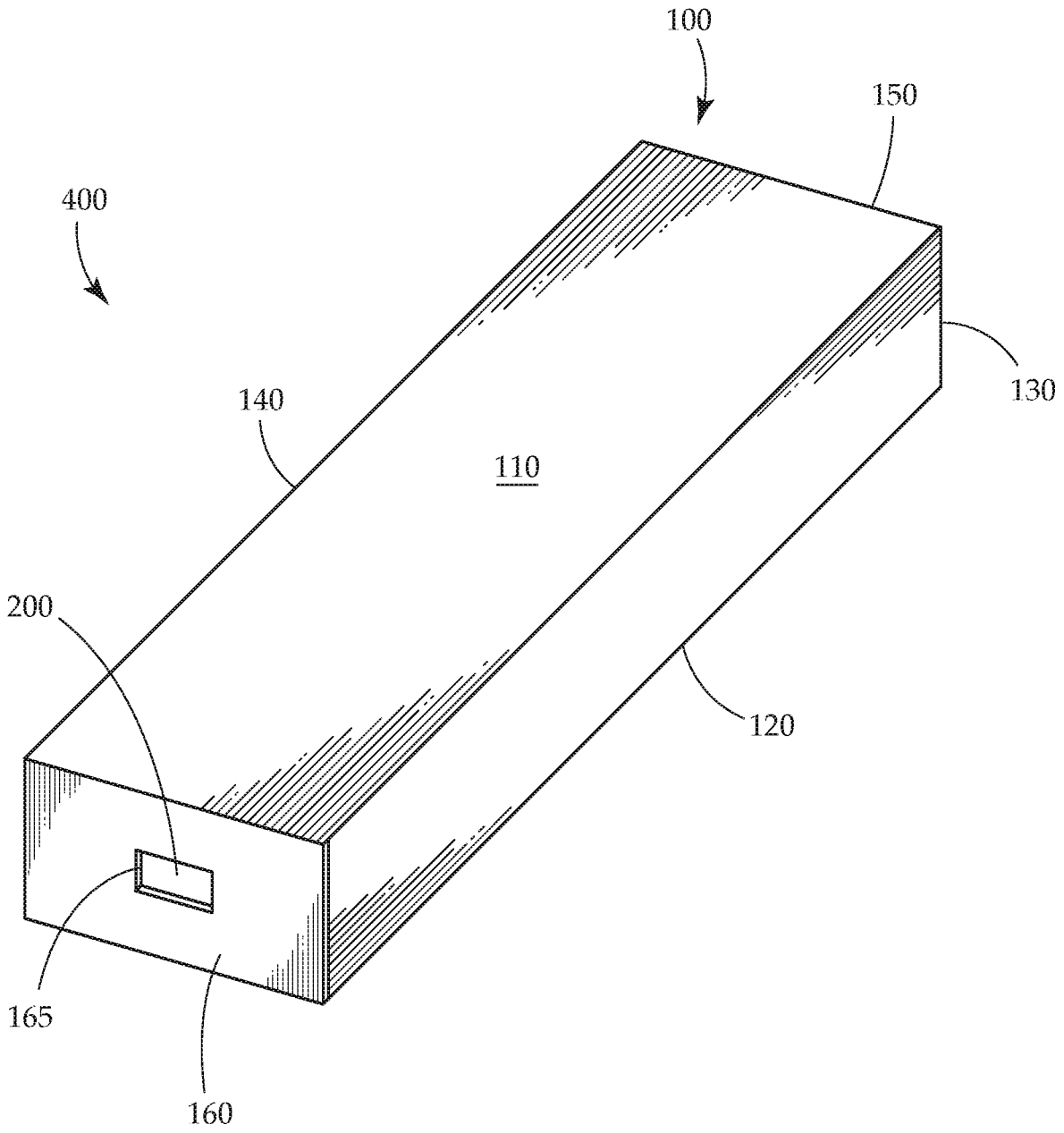
FIG. 1 shows a child-safe cannabis packaging system in accordance with aspects and embodiments.

The present disclosure advantageously provides child-safe cannabis packaging. The disclosed packaging allows for customized branding while still offering features the prevent easy access by children. The disclosed child-safe packaging can be dimensioned to accommodate any cannabis product. As used herein, a cannabis product is any product that contains any form of cannabis and/or any of its derivatives, including but not limited to cannabidiol (CBD) and tetrahydrocannabinol (THC).

The packaging of the present disclosure uses two main pieces, an inner package, and an outer sleeve. In accordance with aspects and embodiments, the inner package and the outer sleeve may be any elongated shape, provided both the inner package and outer sleeve have matching cross sections. The inner package and outer sleeve may, for example, be cylindrical tubes, triangular prisms, rectangular tubes, and hexagonal tubes. Additional suitable geometries will be readily selected by those of skill in the art. The inner package holds the product in its interior. The inner package, though having a cross-section matching the shape of the outer sleeve, may have a variety of constructions. For example, in the case of an elongated rectangular outer sleeve and inner package, the inner package may be constructed like a cigarette carton with a flip top and hold individually pre-rolled joints. Alternatively, the inner package may be rectangular with flap that when opened, reveals a contoured cavity that holds a vial. The vial may be CBD oil or oil containing THC, the psychoactive component in cannibals, an oil designed to be fit on device for smoking, or a vial containing cannabis flower. Similarly, the inner package may house edible cannabis products, for example, lozenges in a blister pack.

When offered for sale, the outer sleeve fully encases the inner package. The outer sleeve is closed on one end such that the inner package can be inserted into the inner sleeve and abutted against the closed end of the inner sleeve. The outer sleeve has an internal width approximately equal to the external width of the inner package but in some embodiments, the outer sleeve may have a length that is longer than the inner package. In some embodiments, the outer sleeve is from about 0.01 mm to 50 mm (~1 inch) longer than the internal package, from about 10 mm to about 40 mm longer than the internal package, and in a preferred embodiment, the outer sleeve is 25.4 mm longer than the inner package, i.e., ½ an inch.

Both the outer sleeve and inner package are preferably constructed out of inexpensive, flexible material, and may be constructed of a cardstock of suitable thickness. The packaging may, alternatively, be constructed out of plastic sheeting of an appropriate thickness. The material selected and thickness of the selected material for the inner package may vary based on the structure of the internal package, i.e., based on the cannabis product it houses. Suitable materials of suitable thickness for both the internal package and outer sleeve with be readily selected by those of skill in the art.

In some embodiments, on or both of the inner package and the outer sleeve may have a coating on their outer surfaces. A portion of the internal surface of the outer sleeve may also be coated. This coating may enhance the friction between the inner package and the outer sleeve, such that the inner package cannot slide freely out from the outer sleeve. The coating may be any material operable to enhance a friction or otherwise limit movement between the inner package and outer sleeve. In one embodiment, the coating may be a bi-oriented polypropylene film.

One or more edges or sections of the outer sleeve may include a reinforcement to prevent access to the inner package by tearing of the outer sleeve. The reinforcement of edges, corners, and/or sections of the outer sleeve advantageously reduces the ability of a child to tear through the packaging, either with their hands, teeth, or with the assistance of household objects. The reinforcement may be any tear resistant material and the tear resistant material may be applied as a tape, sheet, lamination, coating, or any combination thereof. Suitable tear resistant materials include, but are not limited to fiber, plastic, elastomeric, fiber tape, mono-oriented polypropylene, PET film, as well as membrane tapes, sheets, laminations, coatings and composite material. Suitable tear resistant materials and suitable forms of application will be readily selected by those of skill in the art.

Moreover, in many embodiments, the outer sleeve is formed so as to have no external corners that can provide an opening for undesired access such as is seen in most packaging. An external corner is seen in typical box packaging where a corner of a flap or other part of material is exposed or only covered by tape, allowing for a weak point that can be torn or pried open. As is well known to anyone who has opened a package, the corner is the easiest weak spot which can be picked at and pried away, allowing for a better grip for even more tearing. In still further embodiments, the outer sleeve has only one external seam, formed by a top arm which folds over the top of the outer sleeve. The top arm is sealed via tape, adhesive, or other bonding. Preferably this top arm folds into the front opening of the outer sleeve and is connected therein, again eliminating an external corner which could be a weak point. In most embodiments, the top arm is equipped with a tear resistant material such that, in the unlikely event part of it is pried up, the arm cannot be torn away, further reinforcing the outer sleeve and protecting the contents inside.

The outer sleeve has on its closed end an access cutout that allows access to a small portion of the inner package, upon removal of a partially cut profile within the cutout. After removal of the partially cut profile from the access cutout, an access hole is created, which may allow an adult user to access the cannabis product in the packaging by inserting a key or similar item they have on hand of sufficient size and length into the access hole and applying force to the inner package. Similarly or alternatively, a force from an item may be applied to the partially cut profile, thus knocking out the profile and allowing the item to apply a force to the inner package within the outer sleeve. In either case, the force exerted on the inner package may be sufficient to overcome the fit of the inner package within the outer sleeve, thus pushing the inner package out of the outer sleeve. The user can then use their hand to pull the inner package fully out of the outer sleeve and access the interior of the inner package.

Figure 2:
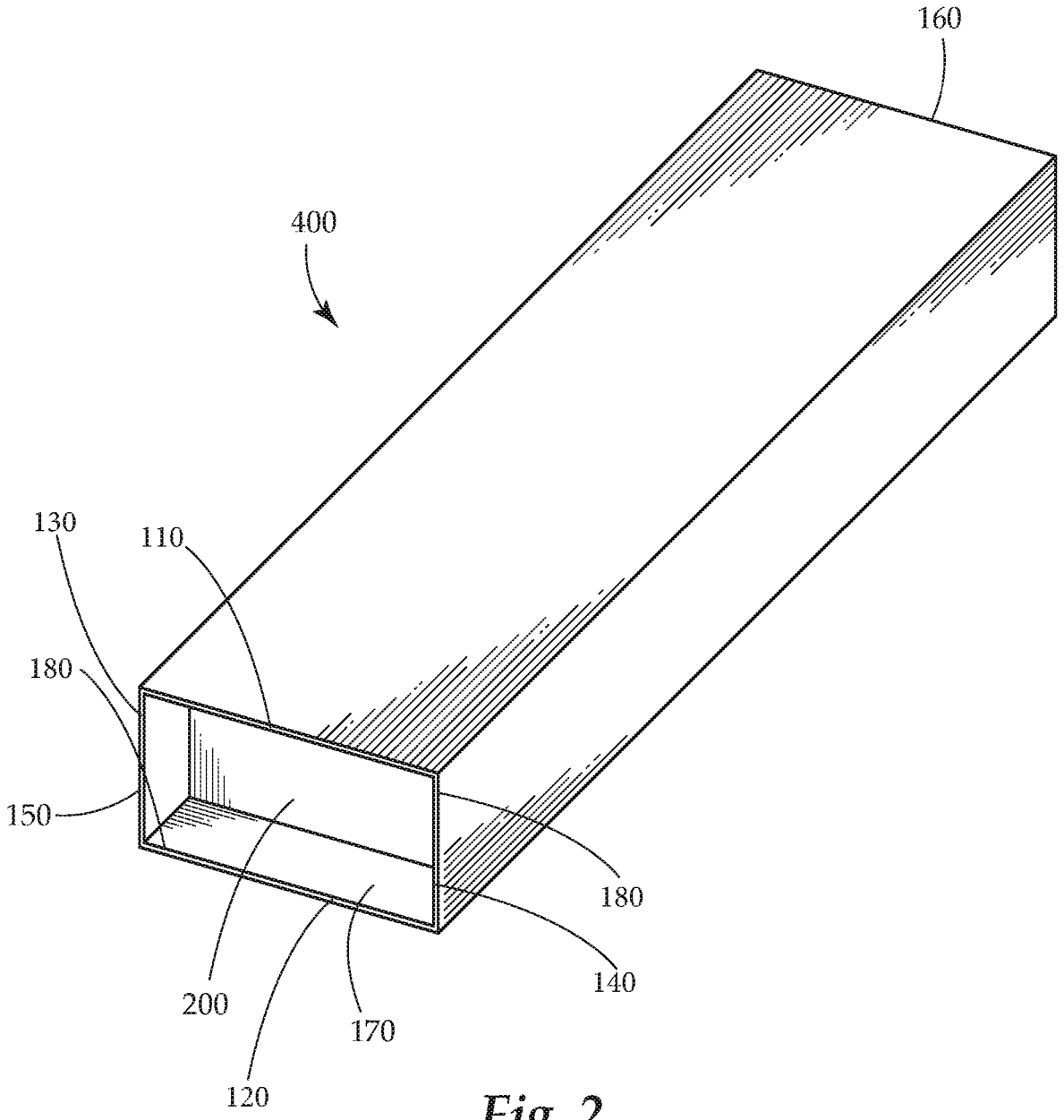
FIG. 2 shows a child-safe cannabis packaging system in accordance with aspects and embodiments.
Figure 3:
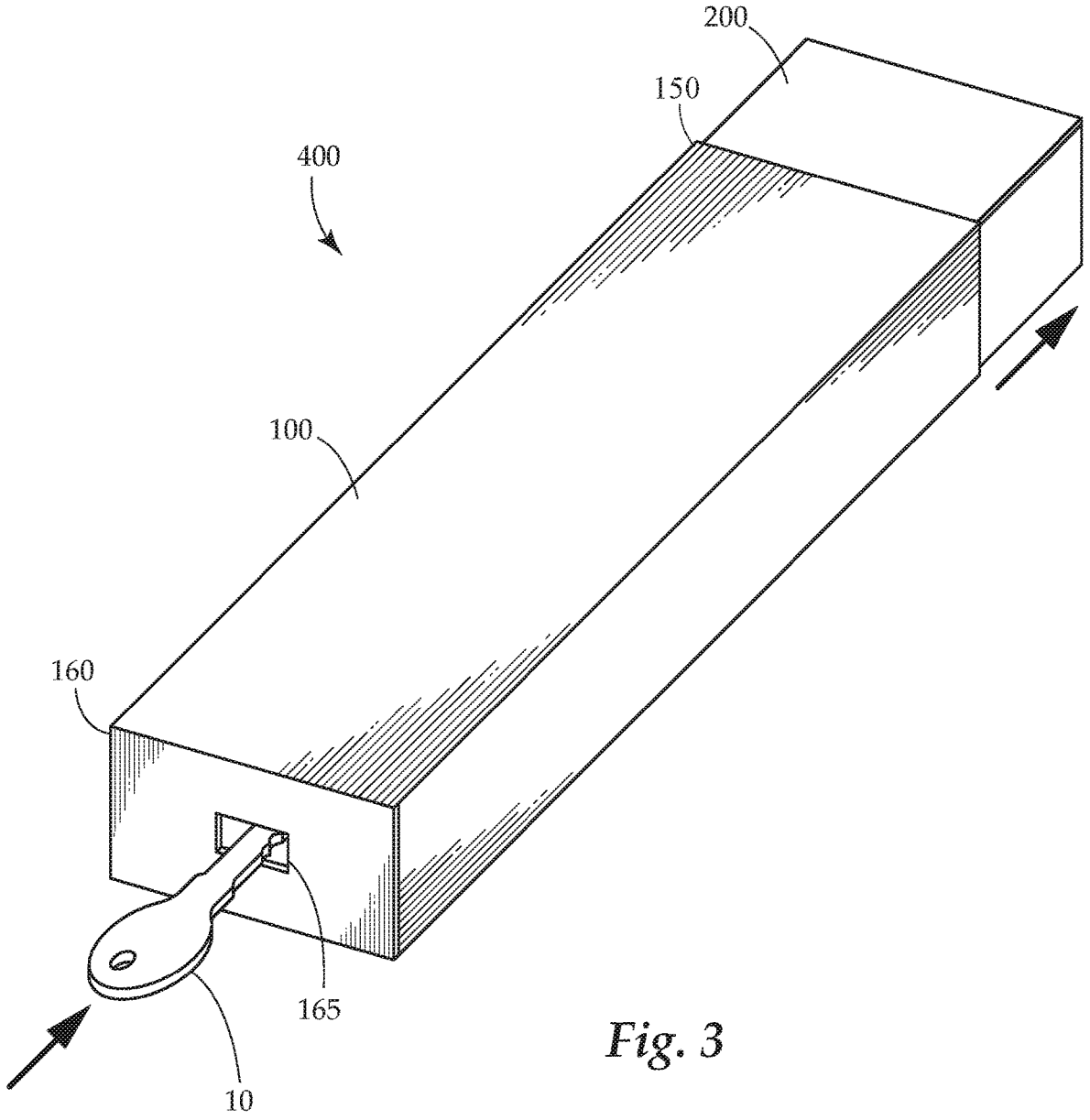
FIG. 3 shows the operation of a child-safe cannabis packaging system in accordance with aspects and embodiments.

In accordance with aspects and embodiments, packaging 400 is shown in FIG. 1-4. Referring to FIG. 1, packaging 400 has outer sleeve 100 and inner package 200. Outer sleeve 100 has top 110, bottom 120, sides 130 and 140, open end 150, closed end 160, and access hole 165. Access hole 165. Referring to FIG. 2, when inner package 200 is fully within outer sleeve 200 such that one of its ends abuts closed end 160, open 150 of sleeve 100 has exposed inner surfaces 170. The length of exposed surfaces 170 is uniform on internal surfaces of sleeve 100. In some embodiments, exposed inner surfaces 170 may have a length of 2 inch. In some embodiments, inner package 200 may have a length that is roughly 85% the length of outer sleeve 100. In other embodiments, inner package 200 may have a length that is roughly 92% of outer sleeve 200. In other embodiments, the length of the inner package 200 may have a length ranging from 50% to 99% the length of the outer sleeve 100. In still other embodiments, the length of the inner package 200 may have a length ranging from 85% to 99% the length of the outer sleeve 100. In still other embodiments, the length of the inner package 200 may have a length ranging from 85% to 92% the length, or 85% to 99% of the outer sleeve 100. Other ranges between 50%-99% and percentages in between are also contemplated by the present disclosure.

Exposed surfaces 170 may be formed by the folding of flaps into the interior of sleeve 100. Thus, exposed surfaces 170 may have a thickness that is greater than the thickness of the remaining portions of the sleeve. Outer sleeve 100 may therefore have a first inner perimeter formed by top 110, bottom 120, sides 130 and 140, and a second inner perimeter that is smaller than the first inner perimeter, where the second inner perimeter is formed by top 110, bottom 120, sides 130 and 140, overlapped with a second layer of material 180 that creates exposed surfaces 170. The reduced perimeter further secures inner package 200 within outer sleeve 100 and provides another degree of friction that must be overcome to remove inner package 200 from outer sleeve 100.

When an adult user wants to access a product contained within inner package 200, the user inserts a key 10, provided by the user, into access hole 165. Key 10 makes contact with inner package 200. The user applies force to inner package 200 via key 10, forcing inner package 200 out of out the open end 150 of outer sleeve 100.

Figure 4A:
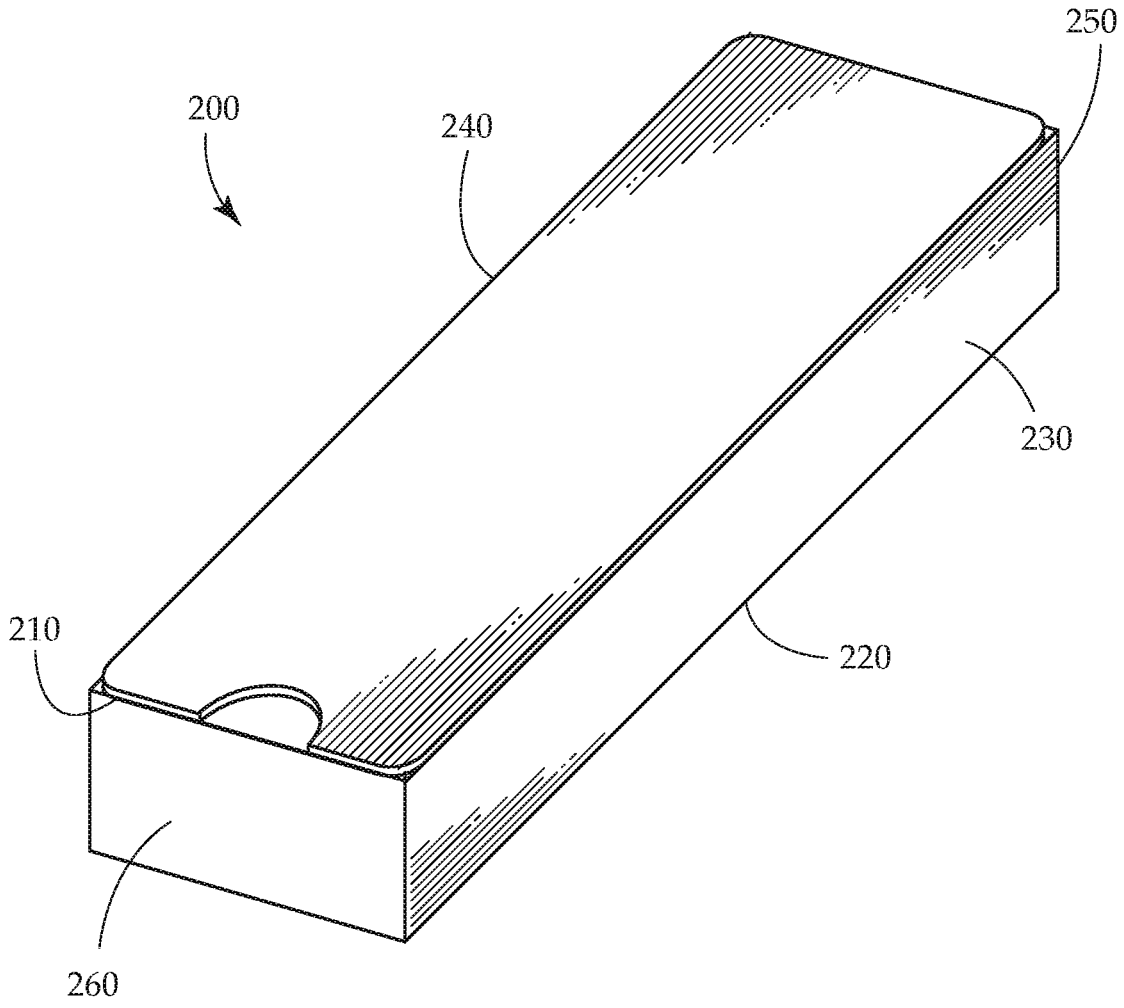
FIG. 4A shows an internal package of child-safe cannabis packaging system in accordance with aspects and embodiments.
Figure 4B:
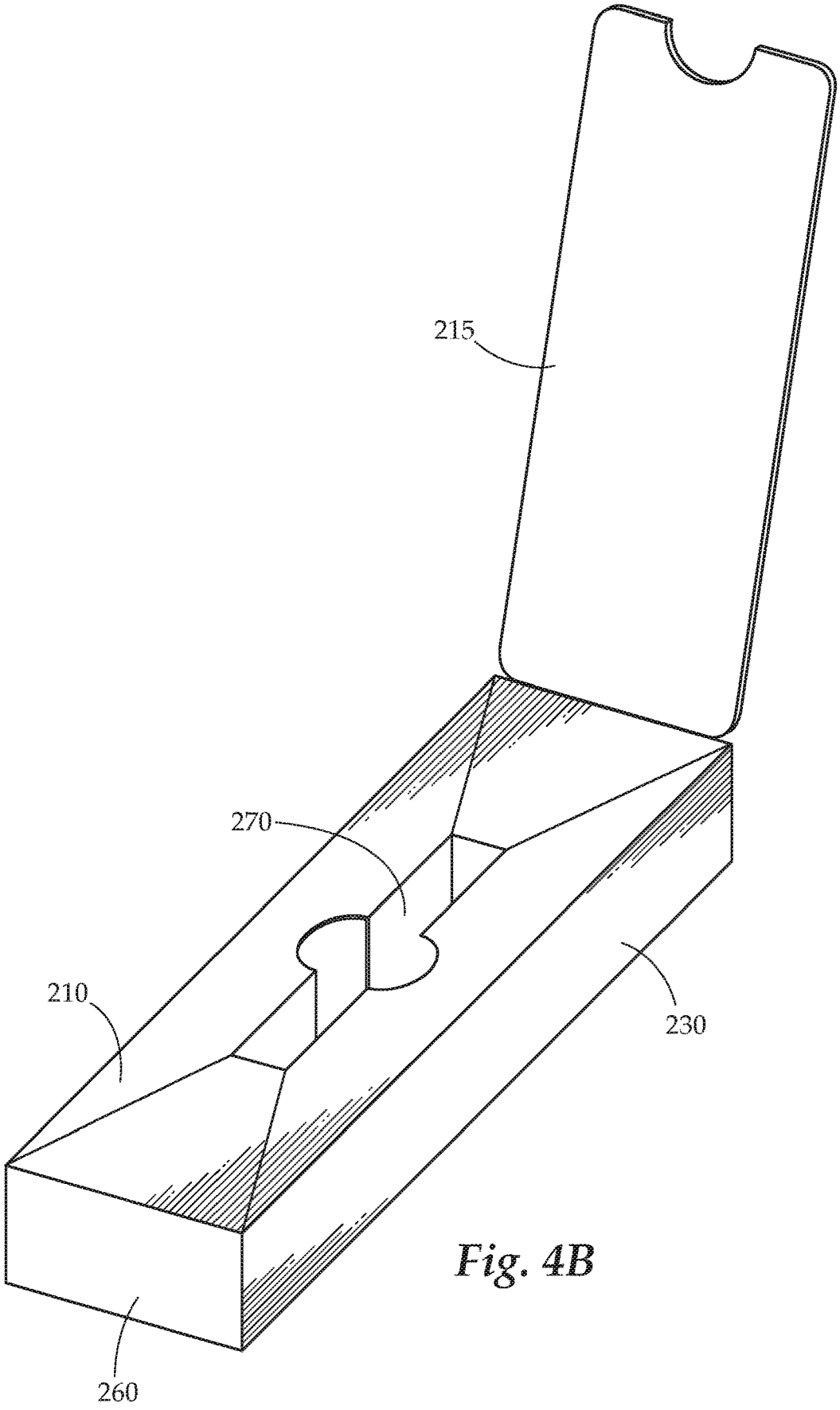
FIG. 4B shows an internal package of child-safe cannabis packaging system in accordance with aspects and embodiments.

In accordance with aspects and embodiments and referring to FIGS. 4A-4B, inner package 200 has top 210 covered by flap 215, bottom 220, sides 230 and 240, and ends 250 and 250. Inner package 200 further has internal cavity 270 dimensioned to hold a cannabis product. Internal cavity 270 may be any shape and may be tailored for the specific product intended to be held by a given internal package 200. Internal cavity 270 may hold a cannabis product and cannabis products may be sold in cavity 270 of packaging 400. Alternatively, internal cavity 270 may hold a non-cannabis product and packaging 400 may be used for non-cannabis products.

Figure 5A:
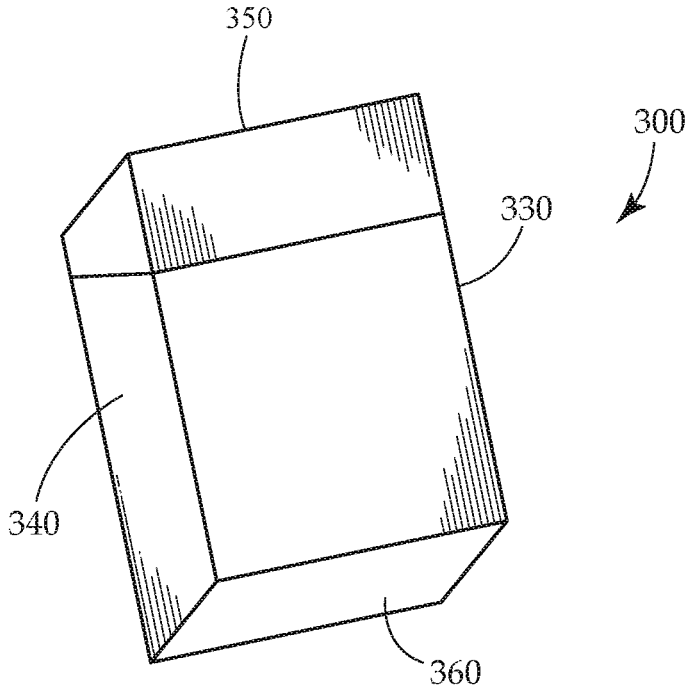
FIG. 5A shows an internal package of child-safe cannabis packaging system in accordance with aspects and embodiments.
Figure 5B:
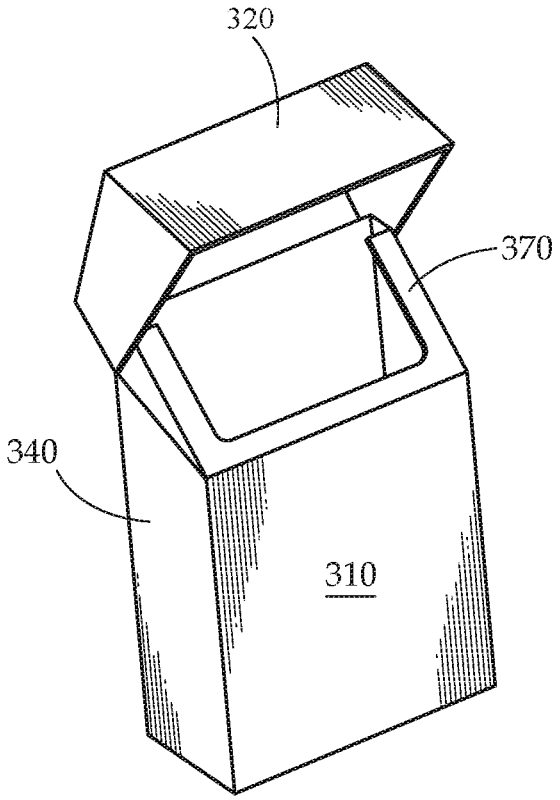
FIG. 5B shows an internal package of child-safe cannabis packaging system in accordance with aspects and embodiments.

In accordance with aspects and embodiments and referring to FIGS. 5A-5B, outer sleeve 200 may, alternatively, hold internal package 300. Internal package 300 has front 310 and back 320, sides 330 and 340, top 350 and bottom 360. Top 350 flips open to provide access to internal cavity 370. Internal cavity 370 may contain a cannabis product and cannabis products may be sold in cavity 370 of packaging 400. Alternatively, internal cavity 370 may hold a non-cannabis product and packaging 400 may be used for any non-cannabis products as well.

Outer sleeve 100 may have additional features that further prevent child access. For example, outer sleeve 100 may include one or more reinforcements in one or more locations to reduce the tearability of outer sleeve 100. These reinforcements advantageously reduce the likelihood of a child tearing through outer sleeve 100 and accessing the cannabis product contained in inner package 200. Reinforcements may, for example, be applied around access hole 165, the edges of closed end 160, and the edges of the open end 150.

In accordance with embodiments, a tear resistant material may be applied around access hole 165 such that it cannot be easily torn. The tear resistant material may be around the perimeter of access hole 165, may be applied to the entire surface of closed end 160, or may be applied to a portion of surface 160 surrounding access hole 165. The tear resistant material may be applied with may be adhered to the inner surface of outer sleeve 100 with an adhesive. Tear resistant material may further be applied to the interfaces, i.e., the edges, formed between closed end 160 with top 110, bottom 120, and sides 130 and 140. The tear resistant material may be applied to, for example, both closed end 160 and top 110, such that it spans the interface formed between surface 160 and surface 110. Alternatively or in combination with an adhesive backed material, the entire inner surface of outer sleeve 100 may include a tear resistant coating. One or more tear resistant materials may further be applied to the interfaces at open end 150 formed between surfaces 170 and top 110, bottom 120, and sides 130 and 140. Tear resistant material may further be applied to the interfaces formed between top 110 and sides 130 and 140, and the interfaces formed between bottom 120 and sides 130 and 140. When applied to these interfaces, the tear resistant material reduces the tearability of outer sleeve 100 at open end 150.

Figure 6:
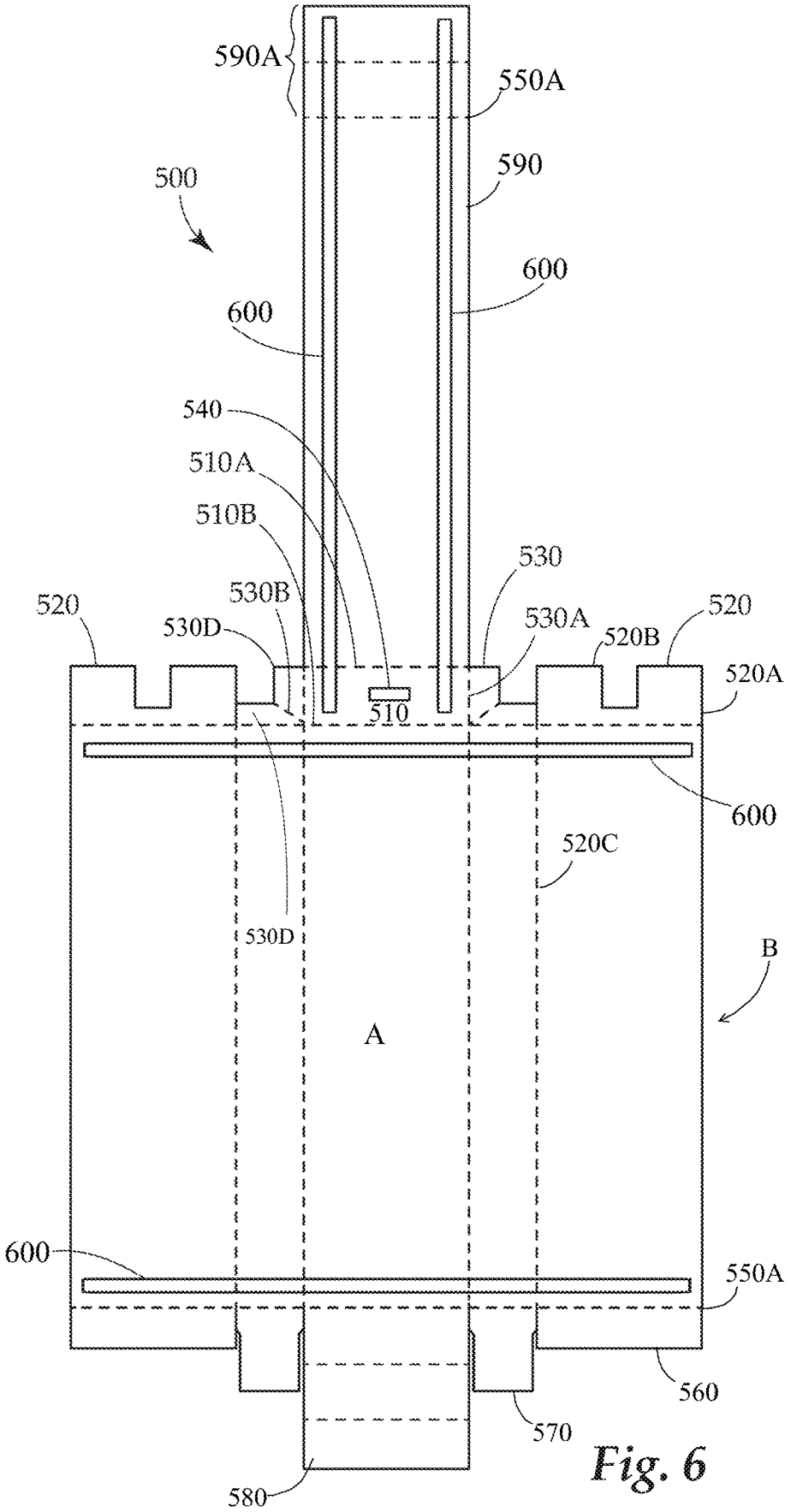
FIG. 6 shows a blank of an outer sleeve of a child-safe cannabis packaging system in accordance with aspects and embodiments.

In accordance with aspects and embodiments and referring to FIG. 6, the outer sleeve of the disclosed child-safe cannabis packaging may be made from a blank, such as blank 500. Blank 500 has an uncoated side A and may have a coated side B, coated with a specialty coating. In some embodiments, both sides A and B of blank 500 may be uncoated. In other embodiments, both sides A and B of blank 500 may be coated and the coating on side A may include a tear resistant coating. Blank 500 is folded along fold lines, shown as dotted lines, to create the three-dimensional disclosed outer sleeve having a closed end with an access hole and an open end that houses internal packaging. The fold lines may be scores or markings on the blank, or may simply be unmarked areas that are folded by hand or using a machine. Blank 500 is folded into a three-dimensional sleeve having a length equal to the distance between fold lines 510B and 550A. The closed end of the sleeve having access hole 540 is formed by folding flap 530 having sections 530D and 530E onto section 510 at folds 530A and 530B. Fold 530A is folded inward such that section 530D of flap 530 is folded onto section 510 as fold 530B is also folded inward such that 530E is folded onto 530D. Flap 520, upon folding 520C is positioned such that its two arms 520A and 520B straddle either side of opening 540. Both of flaps 520 and 530 are on an inside of the section 510 and thus inside the outer sleeved when formed. The unique shape of flaps 530 and 520 and fold line 530B allows for the construction of a rectangular sleeve having a closed end with an access hole such that the flaps 530 and 520 do not interfere with the access hole 540.

Importantly, in the embodiment shown, the blank as shown allows the outer sleeve to be formed as from a single continuous piece of material. This allows all of the flaps and corners to be folded in on themselves into the formed outer sleeve. This can greatly enhance the security of the outer sleeve because it has no external corners of material which can easily be pried up. Also importantly, the sides are able to be folded inward to define the length of the outer sleeve and the cavity therein without external corners. Fold lines at 550A allow the sides of the outer sleeve to be folded in at the front end to reinforce the front of the outer sleeve and again to eliminate open corners. The sides of the blank fold over to form the side and top of the outer sleeve, and then arm 590 folds over the top of these sides. This eliminates open corners and forms the only exposed edge of material in the constructed outer sleeve. The arm 590 is securely adhered to the adjacent part of the blank and is reinforced with tear-resistant material 600 such that, in the unlikely event that an edge is pried up, it cannot be torn away. Portion 590A is tucked into the front of the formed outer sleeve so that there is no accessible corner of the arm 590 which are easier to pry up than a side length.

Tear resistant material 600 is shown in this embodiment as two strips extending on the length of arm 590, as well as across the length below fold line 510B and above fold line 550A. This prevents access to the interior by a tearing of the blank when in an assembled position. In other embodiments, tear resistant material may be laminated between one or more flaps of blank 500 to reinforce the edges of the resulting outer sleeve. For example, a tear resistant material may be laminated between section 510 and 530D and/or between flaps 530E and 530D to reinforce the edges formed at the closed end of the outer sleeve. Tear resistant material may also, or in the alternative, be applied as a tape, a sheet, a membrane, or a coating, to specific sections of blank 500. For example, a tear resistant tape, such as a fiber tape, may be applied to the perimeter of access hole 540. Alternatively, a sheet, membrane, or coating, may be applied to a larger portion of surface 510 surrounding access hole 540, or may be applied to the entire surface 510.

Flaps 560, 570, and 580, positioned at what becomes the open end of the sleeve, are folded inward towards the interior of sleeve. Folding of flaps 560, 570, and 580 inward creates three coated sections on the interior of the sleeve. Fold 510A is made last such that arm 590 is folded over the already-formed sleeve. Portion 590A of arm 590 is tucked into the interior of the sleeve, creating a fourth coated side on the interior of the sleeve. A tear resistant material may be laminated between flaps 560, 570, 580, and 590A and the interior surface of the resultant outer sleeve to reinforce the open end of the outer sleeve. Arm 590 also serves to reinforce the construction of the outer sleeve.

Flaps 560, 570, 580, and 590A also decrease the internal perimeter of the outer sleeve, thus further securing any inner package positioned within the outer sleeve beyond flaps 560, 570, 580, and 590A. The perimeter is reduced in an amount proportional to the thickness of blank 500. The decreased perimeter at the open end of the outer sleeve operates to further secure an inner package within the outer sleeve and presents an additional degree of frictional that must be overcome to force an inner package out from the outer sleeve formed by blank 500.

While several variations of the present disclosure have been illustrated by way of example in preferred or particular embodiments, it is apparent that further embodiments could be developed within the spirit and scope of the present disclosure, or the novel concept thereof. However, it is to be expressly understood that such modifications and adaptations are within the spirit and scope of the present disclosure, and are inclusive, but not limited to the following appended claims as set forth.

What is claimed is:

1. A cannabis packaging system comprising:

an inner package having a first end, a second end, and an internal cavity dimensioned to hold a cannabis product;

an outer sleeve having a top, a bottom, a first side, a second side, an open end, and a closed end, the closed end having an access hole, and the bottom having two layers of material;

wherein the outer sleeve is longer than the inner package and the inner package fits within an interior of the outer sleeve and wherein the access hole provides access to the first end of the inner package;

wherein the interior of the outer sleeve has a first perimeter and a second perimeter, wherein the second perimeter is smaller than the first perimeter, the second perimeter and the first perimeter being parallel to each other;

wherein the outer sleeve is made by folding an unfolded blank, the unfolded blank comprising a first section defining the access hole, the first section comprising an arm extending away from the first section, a first of the two layers, and a second of the two layers;

wherein the first of the two layers comprises a first plurality of flaps and the second of the two layers comprises a second plurality of flaps, first flap from the first plurality of flaps and a second flap from the second plurality of flaps positioned at what becomes the open end of the outer sleeve;

wherein folding the first flap, the second flap, and a portion of the arm inward after the arm is folded over an already-formed outer sleeve forms the second perimeter and an exposed surface on the interior of the outer sleeve;

wherein the second perimeter being smaller than the first perimeter secures the inner package to the interior of the outer sleeve; wherein a force applied to the first end of the inner package through the access hole causes the inner package to at least partially exit the outer sleeve.

2. The cannabis packaging system of claim 1 wherein a force applied from an item to the first end of the inner package through the access hole moves the inner package from the outer sleeve.

3. The cannabis packaging system of claim 1, wherein both the inner package and the outer sleeve are constructed from materials selected from the group consisting of a plastic sheet and a cardstock.

4. The cannabis packaging system of claim 1, wherein the outer sleeve further comprises a tear resistant material.

5. The cannabis packaging system of claim 4, wherein the tear resistant material is one of a fiber tape or a coating.

6. The cannabis packaging system of claim 1, wherein at least a portion of the interior of the outer sleeve has the surface coating.

7. The cannabis packaging system of claim 1 wherein the outer sleeve comprises a single continuous piece of material, the single continuous piece of material being a folded blank.

8. The cannabis packaging system of claim 1 wherein the arm forms a top of the outer sleeve, and the arm is folded into the open end.

9. The cannabis packaging system of claim 8 wherein the folded arm is sealed to the top of the outer sleeve by a tear resistant tape.

10. The cannabis packaging system of claim 1 wherein the outer sleeve comprises a flexible material.

11. A packaged cannabis product comprising:

an inner package having first end, a second end, and an internal cavity dimensioned to hold a cannabis product;

a cannabis product in the internal cavity; and an outer sleeve having a top, a bottom, a first side, a second side, an open end, and a closed end, the bottom having two layers of material;

wherein the outer sleeve is longer than the inner package and the inner package fits within an interior of the outer sleeve;

wherein the interior of the outer sleeve has a first perimeter and a second perimeter, wherein the second perimeter is smaller than the first perimeter, the second perimeter and the first perimeter being parallel to each other;

wherein the outer sleeve is made by folding an unfolded blank, the unfolded blank comprising a first section defining an access hole, the first section comprising an arm extending away from the first section, a first of the two layers, and a second of the two layers;

wherein the first of the two layers comprises a first plurality of flaps and the second of the two layers comprises a second plurality of flaps, a first flap from the first plurality of flaps and a second flap from the second plurality of flaps positioned at what becomes the open end of the outer sleeve;

wherein folding the first flap, the second flap, and a portion of the arm inward after the arm is folded over the two layers of material forms the second perimeter and an exposed surface on the interior of the outer sleeve;

wherein the second perimeter being smaller than the first perimeter secures the inner package to the interior of the outer sleeve.

12. The packaged cannabis product of claim 11, wherein the closed end of the outer sleeve has an access hole.

13. The packaged cannabis product of claim 11, wherein the access hole provides access to the first end of the inner package and when a force applied to the first end of the inner package through the access hole, the inner package at least partially exits the outer sleeve.

14. The packaged cannabis product of claim 13, wherein at least a portion of an internal surface of the outer sleeve has a surface coating.

* * * * *